US006757986B2

(12) United States Patent
Miller et al.

(10) Patent No.: US 6,757,986 B2
(45) Date of Patent: Jul. 6, 2004

(54) PORTABLE (MINI) CLOTHES & HAIR DRYER

(75) Inventors: Rhona A. Miller, Massapequa, NY (US); Halden A Morris, Kingston (JM)

(73) Assignee: Rhona Miller, Altamonte Springs, FL (US)

( * ) Notice: Subject to any disclaimer, the term of this patent is extended or adjusted under 35 U.S.C. 154(b) by 13 days.

(21) Appl. No.: 10/216,783

(22) Filed: Nov. 18, 2002

(65) Prior Publication Data

US 2004/0093758 A1 May 20, 2004

(51) Int. Cl.[7] ..... D06F 58/04

(52) U.S. Cl. ..... 34/132; 34/534; 34/563; 34/82; 34/90; 34/99; 34/602

(58) Field of Search ..... 34/534, 562, 563, 34/82, 90, 96, 97, 99, 130, 132, 595, 602, 603, 134, 140, 218, 235; 220/8

(56) References Cited

U.S. PATENT DOCUMENTS 3,577,650 A * 5/1971 Brahm ..... 34/622
3,659,108 A * 4/1972 Quase ..... 250/506.1
5,388,344 A * 2/1995 Wallach ..... 34/91
5,483,562 A * 1/1996 Kornfeldt et al. ..... 376/287
5,555,648 A * 9/1996 Griffin ..... 34/621
5,592,750 A * 1/1997 Eichten ..... 34/104
5,829,162 A * 11/1998 Pace ..... 34/202
5,862,932 A * 1/1999 Walsh et al. ..... 220/8
5,992,039 A * 11/1999 Bunch et al. ..... 34/91
5,996,249 A * 12/1999 Manning ..... 34/621

FOREIGN PATENT DOCUMENTS

EP 0 273 580 A2 * 7/1988 ..... D06F/58/04

* cited by examiner

*Primary Examiner*—Ira S. Lazarus
*Assistant Examiner*—Andrea M. Ragonese
(74) *Attorney, Agent, or Firm*—Rhona Miller; Halden Morris

(57) ABSTRACT

This invention is about portable mini clothes and hair dryer which is designed to collapse and fit into a standard suitcase. It possesses all the features of the standard clothes dryer but is approximately one tenth the size and weighs less than 25 pounds. The dryer will not operate in its collapsed state or if the lid is opened. It comprises a simple but reliable heater and motor assembly. The single flat motor drives both the blower fan and the rotating drum of the machine but the rotating drum can be disengaged when the unit is used for drying hair only. Clothes and other items can be packed in and around the dryer when traveling.

14 Claims, 7 Drawing Sheets

PORTABLE (MINI) CLOTHES & HAIR DRYER

BACKGROUND OF THE INVENTION

This invention relates to a miniature portable clothes and hair dryer which is collapsible and convenient for travel. Clothes and hair dryers as household appliances are well known in the art.

The conventional clothes dryer is a relatively large machine with a rotating drum driven by an electric motor. The rotating drum provides a tumbling action for the clothes being dried. This device also feature an electrical heat source which produces hot air that passes over the clothes as the drum rotates. The conventional dryer is designed to dry several pounds of clothes at a time and is usually permanently installed in the building and requires a large amount of electricity to operate.

Portable clothes dryers on the other hand have been developed to facilitate drying of small quantities of clothes, especially for traveling persons, however, most of the designs investigated prove to be bulky for transporting and inefficient in drying clothes. Hair dryers are usually a separate device.

One type, U.S. Pat. No. 5,870,836 features an 18 inch floor fan with racks on which the clothes are placed. Clothes drying is primarily dependent on the turbulent air flow from the fan blades.

Two other designs, U.S. Pat. Nos. 5,388,344 and 5,992,037 feature a rotating drum similar to the conventional clothes dryer but uses a conventional hand held hair dryer as the source of heat. These designs, though practical, prove to be bulky and awkwardly shaped for transportation and do not make provision for various types of electrical supplies.

SUMMARY OF THE INVENTION

An intention of the present invention is to provide a miniature, portable clothes and hair dryer which is capable of drying relatively small loads of clothes (several pieces of garments) in a timely and efficient manner, operating on electrical power of either 110 V or 220 V at either 50 or 60 Hertz. It is also an intention of the present invention to provide a device which is collapsible to the size of a standard suitcase and can be used to transport pieces of clothing during travel. By simply attaching a head piece, the dryer can be used as a hair dryer either separately or simultaneously with clothes drying.

The dryer comprises of a heater 21 with two elements with each having a wattage equivalent to a standard hair dryer, a collapsible rotating drum 06 with a drive motor, a timer switch 25, a lid 15 similar to that of a standard clothes dryer, a rear panel 02 with an exhaust compartment and nozzle 12, hair drying apparatus including a filter 27 and a headpiece with hose 28, an outer heat proof fabric case, and a carrying case similar to a standard suitcase 25.

Another objective of this invention is to provide a portable, yet durable and reliable hair/clothes dryer which may be easily manufactured and marketed.

It is expected that this portable dryer will be utilized on vacation and camping trips as well as general domestic usage, provided electricity is available. The dryer will be equipped with appropriate circuitry and adaptors to facilitate connection to either 110 or 220 Volts, 50/60 Hertz power supply since these are the most prominent types of voltages available across the world.

The carrying case will be equipped with appropriate packaging materials 24 to avoid damage during travel.

DESCRIPTION OF THE PREFERRED EMBODIMENTS

Figure 1:
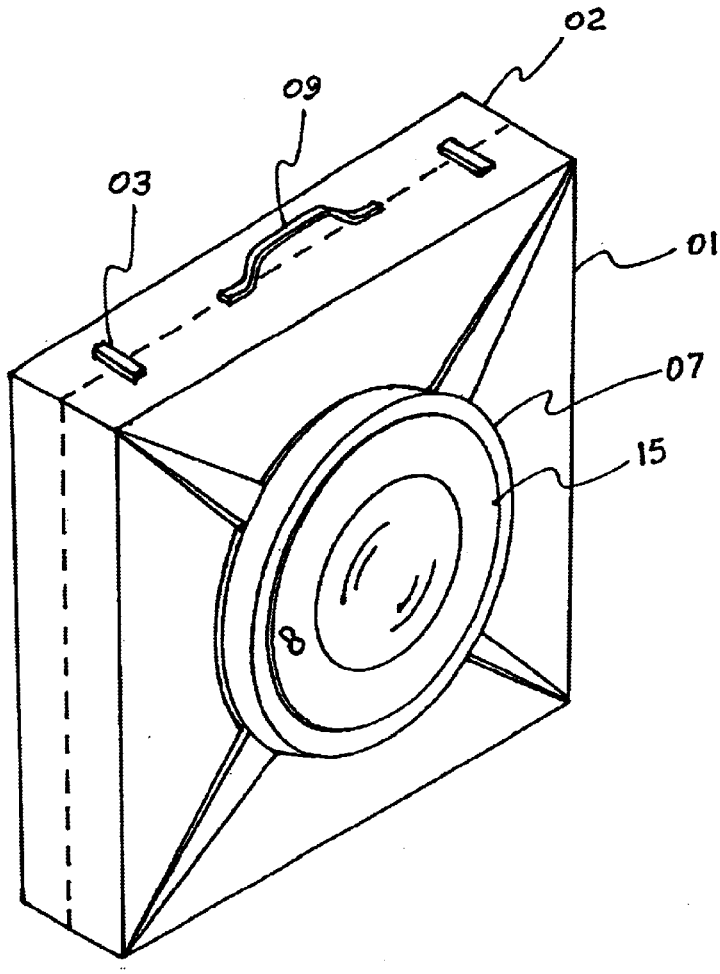
FIG. 1 A perspective view of the miniature clothes dryer in a closed state. This framework can comfortably fit in a suitcase.
Figure 2:
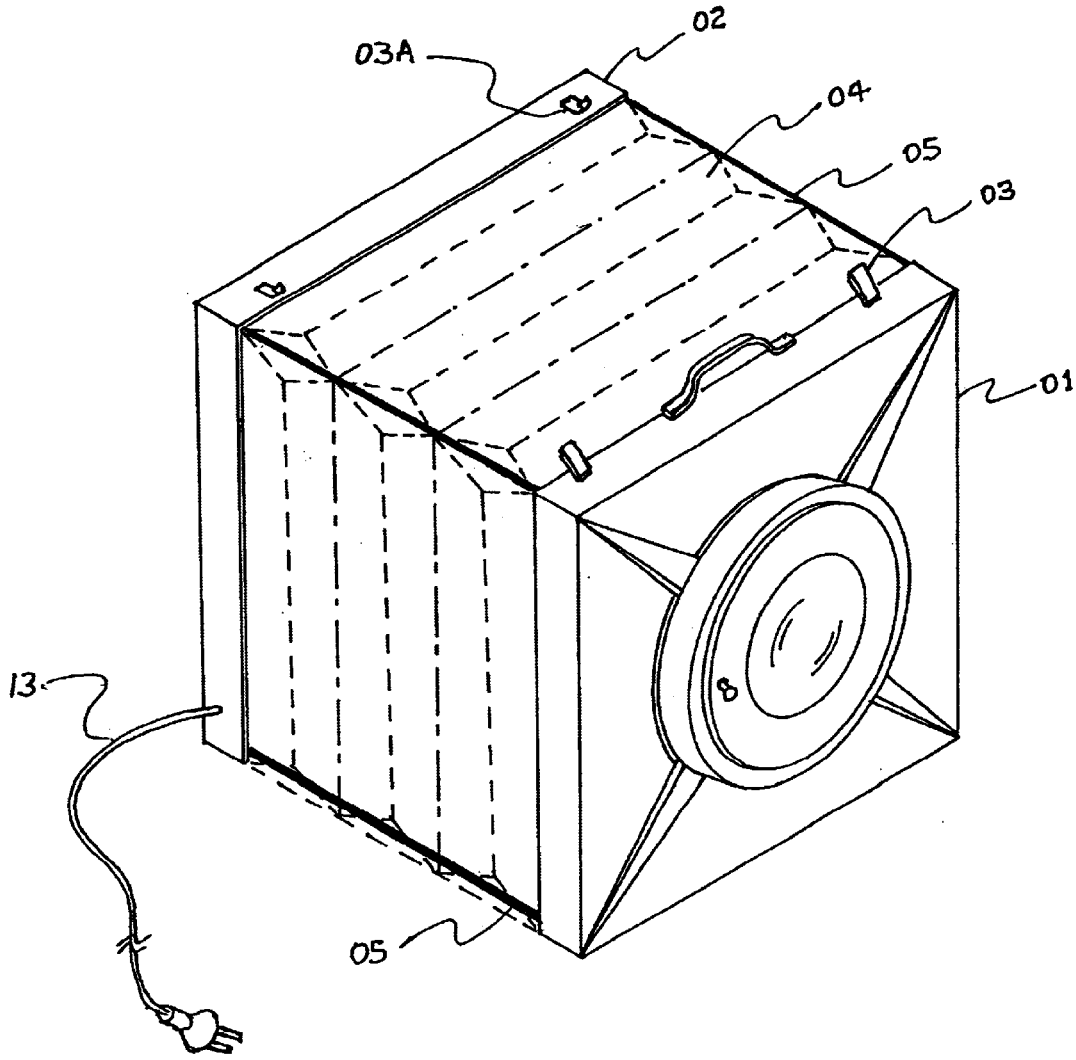
FIG. 2. A perspective view of the miniature clothes dryer in an open state.

FIG. 1 illustrates the miniature clothes and hair dryer in its closed state, with four clasps 03 and 03A, (two at top and two at bottom) holding the front 01 and rear 02 panels together. The unit is equipped with a lifting handle 09. When the clasps 03 are opened, the heatproof fabric casing 04 is exposed, revealing four anchor rods 05 at the corners which are used to provide tension on the outer fabric and keep the dryer in the open state (FIG. 2). Two diagonal anchor rods activates safety switches 22 which prevents the dryer from operating when the unit is closed.

Figure 3:
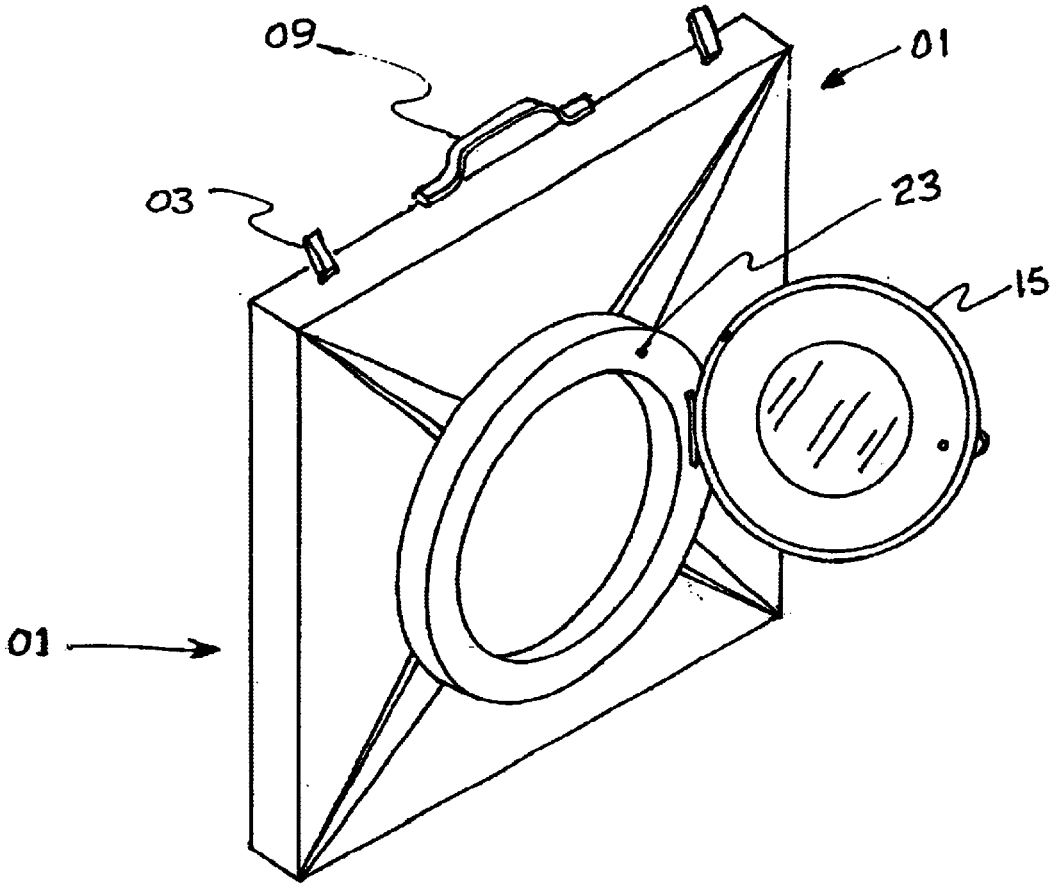
FIG. 3. The inner parts of the dryer. The collapsible inner compartment with multiple perforation holes, rear mount and the front rotation track.
Figure 4:
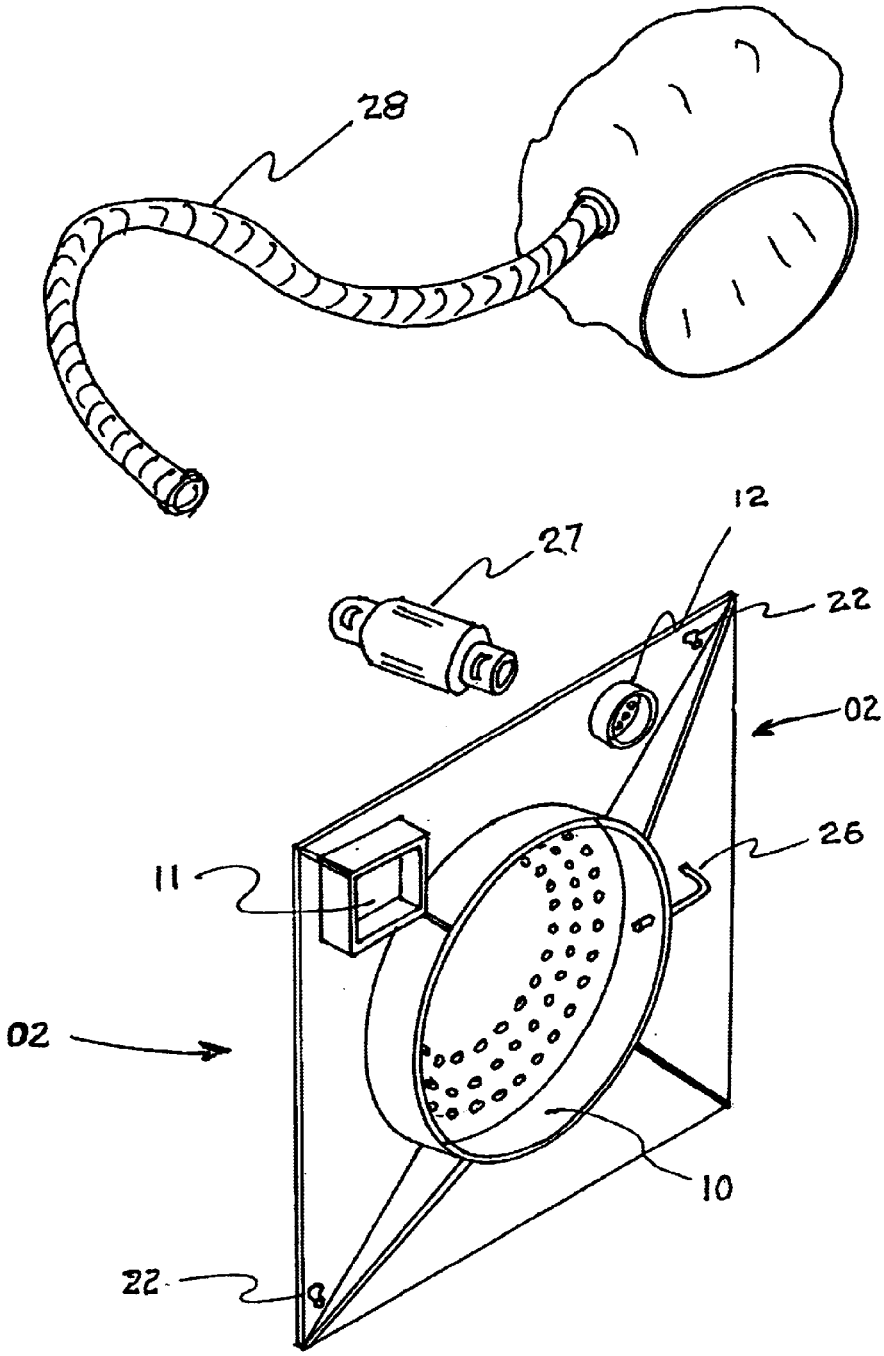
FIG. 4. The rear panel showing the exhaust, motor and heater compartments and hair drying apparatus.

When the dryer is in the operating state, the inner compartment, a collapsible drum 06 extends with cams 19 in its rotation track 18 on the lid support 07 with the other end fastened the motor and heater housing 08 (FIG. 3). The rear panel 02 (FIG. 4) accommodates the motor and heater housing 08 in a compartment 10 and the motor and heater controls are located in compartment 11. The exhaust compartment 12 is also located in the rear panel is designed to accommodate an air filter to which the hose of a hair drier is fitted. The power cord 13 accesses the flat motor 20 and heater 21 through this panel via the control switches in compartment 11.

Figure 5:
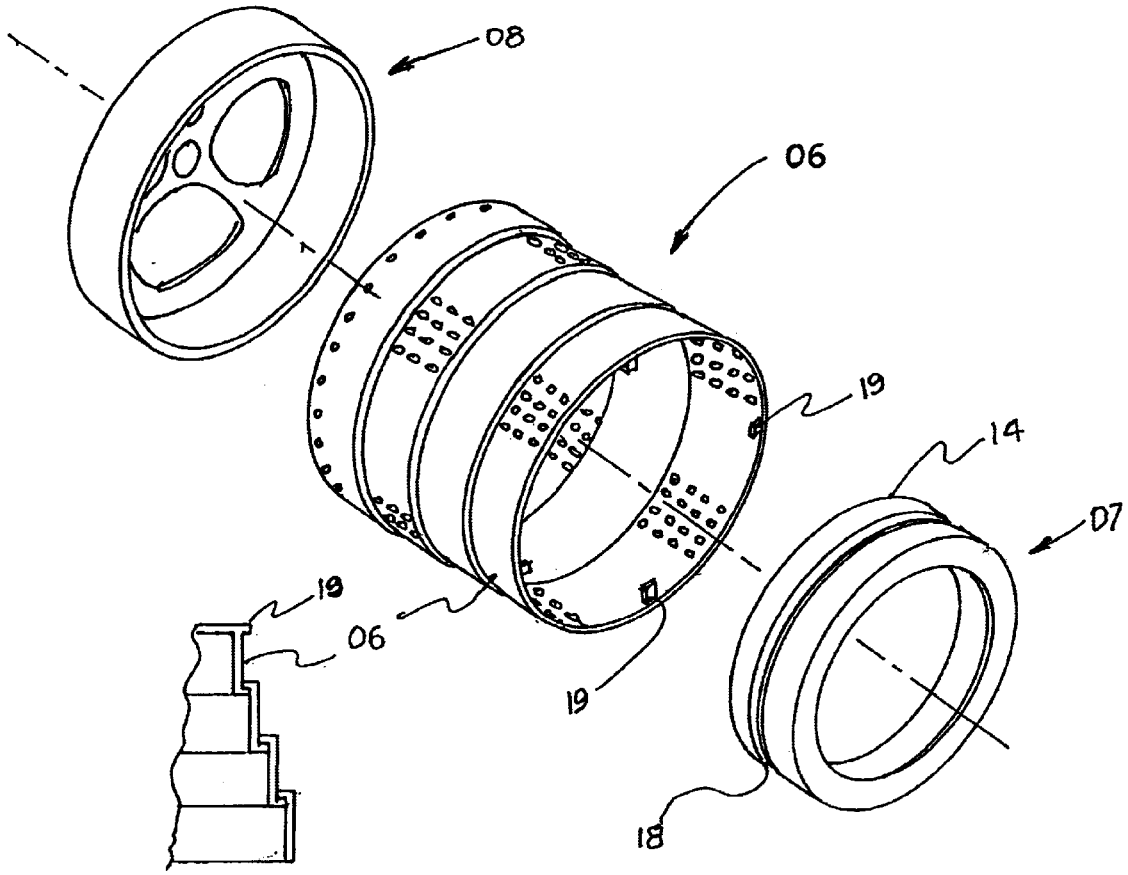
FIG. 5. The front panel with open lid.
Figure 6:
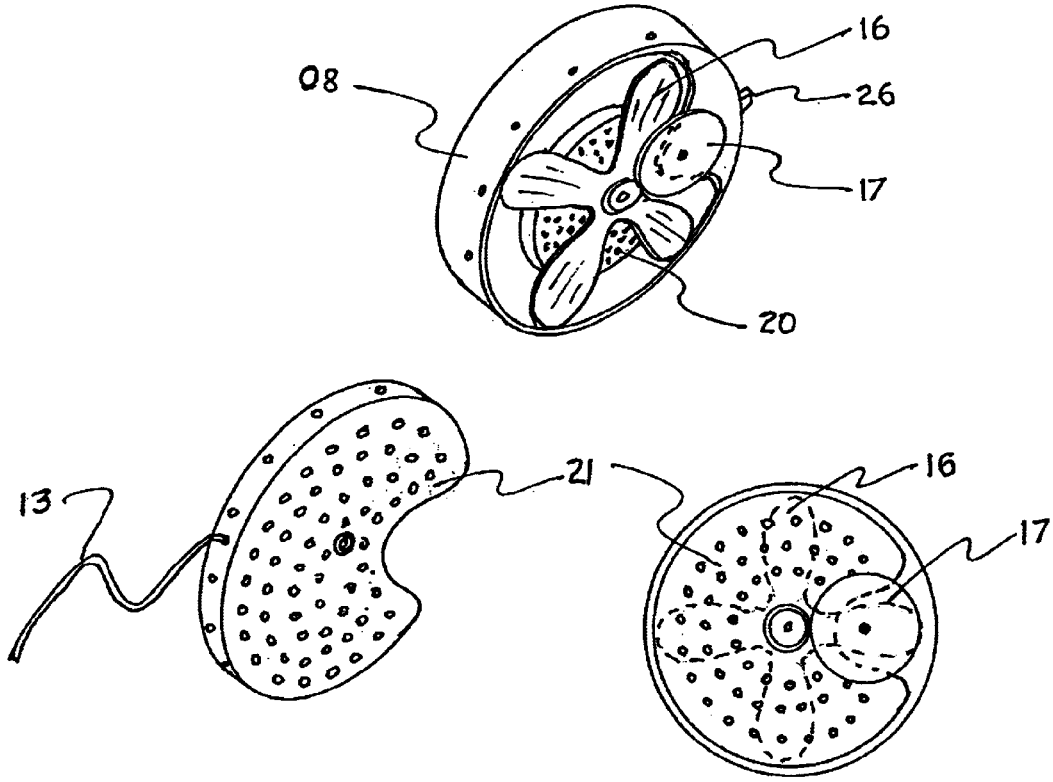
FIG. 6. Motor and heating element assemblies.

FIG. 5 features the front panel 01 with an opening through which clothes is inserted in the dryer. This opening is kept closed with a lid 15 which is hinged on the front panel.

When the timer switch is activated, the motor 20 drives a blower blade 16 and the drive gear 17 for the inner compartment 06. Air from the blower blade passes through the heater 21 which assist in drying the clothes in the rotating inner compartment 06.

By attaching an air filter 27 and the headpiece with hose 28 to the exhaust compartment 12, the unit can be simultaneously used for drying hair and clothes. For drying of hair only, the drive gear 17 for the inner compartment is disengaged using a lever 26.

Figure 7:
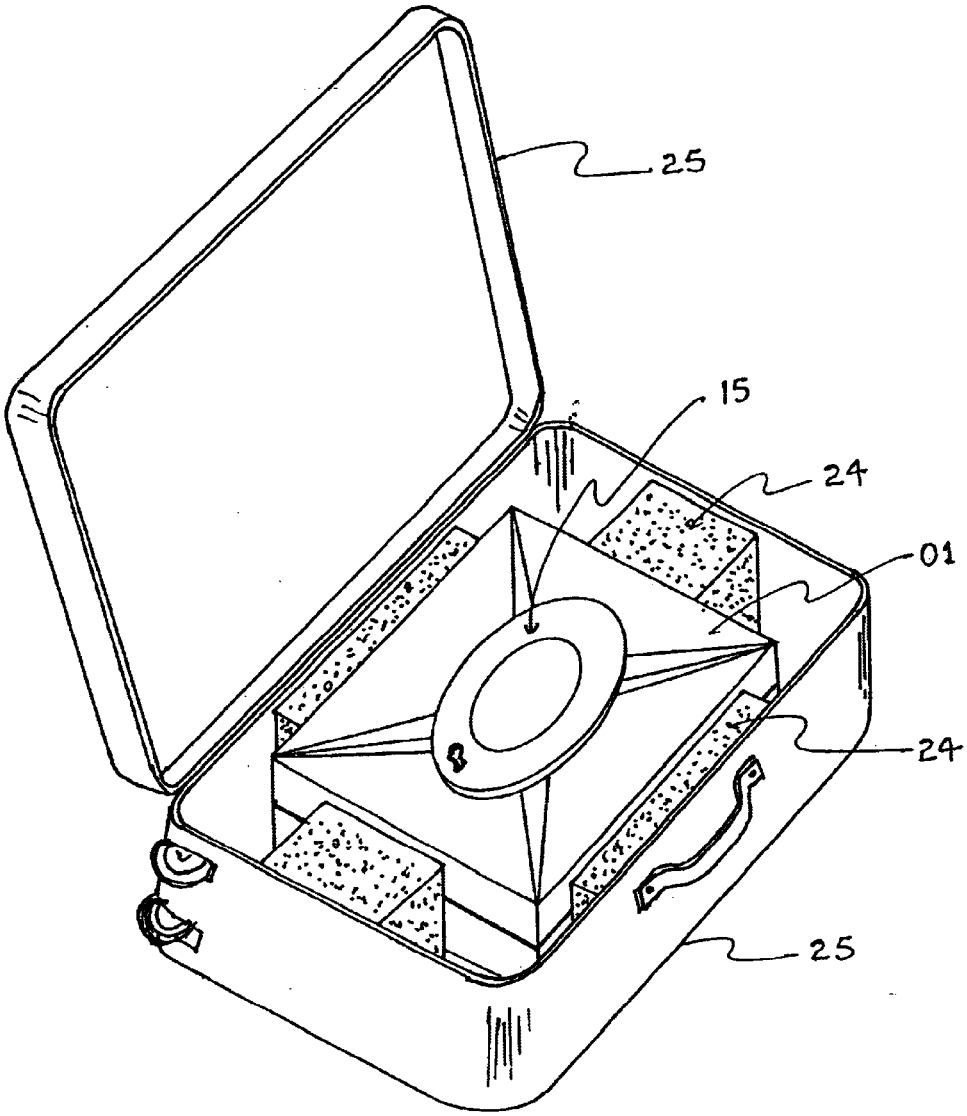
FIG. 7. Sketch of a typical carrying case with portable dryer.

This dryer, we believe, the first of its kind is very light and compact. It measures 18×16×7 inches when closed and 18×16×16 inches when opened. In addition to carrying the hair drying filter, hose and headpiece the dryer can be used for carrying luggage in either the open or closed mode, depending on the volume of luggage and the size of the carrying case (FIG. 7).

The front 01 and rear 02 panels are made from tough heat resistant plastic whereas the sides are fabricated from a flexible heat resistant fabric which allows folding contraction as in the case of expandable suitcases. The carrying case FIG. 7 provides protection for the rear and front panels. This is made in the form of a suitcase 25 and from hard plastic material typically used for manufacturing, suitcases. The dryer is cushioned in the carrying case with hard foam material 24 to avoid damage. The carrying case may be designed to match an individual's set of luggage.

The device will have physical appearance of a modem suitcase with appropriate pulling handle and casters. Other features such as locks, ownership label, etc. will be incorporated in the device. The machine, though complex in operation is simple in design. It consists of an outer compartment as described earlier, which when opened resembles a small clothes dryer. The inner compartment 06, a collapsible cylindrical perforated chamber is made of tough plastic or stainless steel and is driven at a slow speed by the motor and gear mechanism. Heat is supplied in the chamber by the blower blade 16 which rotates at a relatively high speed and provide a draft over the thermostat controlled heater elements 21 located behind the motor in the rear compartment.

POWER, CONTROLS & SAFETY FEATURES

The device will operate safely on either 110 or 220 Volts at either 50 or 60 Hertz electricity which makes it suitable for use in the United States, Europe or other foreign countries. When connected to the electrical supply with the appropriate adaptor, it will automatically adjust to accommodate the voltage supplied to it. The heating elements will be connected in parallel for 110 V and series for 220V operations. The duration of operation is controlled with an electronic timer.

The temperature of the heater and the speed of rotation of the motor will be pre-set at the factory. A thermal overload switch will isolate the device from the electrical supply if an overheating condition develops. The user will not be able to control the speed of rotation of the inner compartment or the temperature of operation. The inner compartment will rotate along a guide support at a speed desirable for optimum performance of the dryer.

The device will not operate if it is in the closed carrying mode. One of the anchoring pegs will trigger a micro-switch 22 to enable the machine. Once the machine is activated, the anchoring peg will not release unless the cycle of operation of the machine is completed. This peg will be kept anchored by a solenoid (not shown) which will deactivate when the cycle of operation is completed. A door switch 23 will prevent the dryer from starting and it will automatically stop if the lid 15 is opened.

We claim:

1. A portable clothes and hair dryer comprising:

a casing defined by a front panel and a rear panel connected by heatproof fabric, wherein said heatproof fabric forms the side, top and bottom walls of the dryer when the dryer is in an open state;

a collapsible cylindrical drum mounted in the casing;

an opening for inserting clothes into said drum;

a lid covering said opening, wherein said lid is mounted on said front panel;

a blower blade;

a drive gear;

a motor for rotating said drum and driving said blower blade to force air over said clothes;

a heater mounted in a heater housing, wherein said heater heats air in dryer;

an exhaust compartment in said rear panel for receiving exhaust air from said drum and for connecting to a hair drying accessory;

at least one safety switch for switching electrical power to at least one of said motor and said heater on and off; and a lever for disengaging said drive gear when dryer is used for drying only hair.

2. The clothes and hair dryer of claim 1, wherein said front panel and said rear panel are made of plastic;

wherein said rear panel has a control compartment for housing a power cord and dryer controls; and wherein said exhaust compartment allows air to escape from said drum to outside the dryer when the dryer is in operation.

3. The clothes and hair dryer of claim 1, wherein heatproof fabric is collapsible to move the dryer between the open state and a closed state.

4. The clothes and hair dryer of claim 1, wherein said front panel and said rear panel latch together when the dryer is in a closed state.

5. The clothes and hair dryer of claim 1, wherein the hair drying accessory is a headpiece attached to a hose.

6. The clothes and hair dryer of claim 1, wherein at least one anchor rod is used to keep said front panel and said rear panel separated when the dryer is in the open state.

7. The clothes and hair dryer of claim 1, wherein cams and a cam rotation track facilitate rotation of said drum between said front panel and said motor.

8. The clothes and hair dryer of claim 1, wherein an electronic timer switch turns off at least one of said motor and said heater after a pre-selected time period has lapsed.

9. The clothes and hair dryer of claim 1, wherein said at least one safety switch turns off at least one of said motor and said heater when lid is opened, the dryer is moved into a closed state or said motor stalls.

10. The clothes and hair dryer of claim 1, wherein in a closed state, the dryer is accommodated in a carrying case with rollers.

11. The clothes and hair dryer of claim 1, wherein said motor is securely fastened to said rear panel; and wherein said drum can be disengaged from said motor by moving said lever.

12. The clothes and hair dryer of claim 1, wherein the dryer can operate on at least a 110 Volts electrical supply with a 60 Hertz frequency and a 220 Volts electrical supply with a 50 Hertz frequency.

13. The clothes and hair dryer of claim 1, wherein said hair dryer accessory is attached to said exhaust compartment via an air filter, wherein said air filter traps at least one of dust and lint exhausted from said drum.

14. The clothes and hair dryer of claim 1, wherein said at least one safety switch prevents the dryer from operating when the dryer is in a closed state.

* * * * *